US006035450A

United States Patent [19]

Monsen, III et al.

[11] Patent Number: 6,035,450

[45] Date of Patent: Mar. 14, 2000

[54] HEAD GEAR FOR WORK IN RADIOACTIVE ENVIRONMENTS

[75] Inventors: Andres Monsen, III, Santa Fe Springs; John Joyce, Vista, both of Calif.

[73] Assignee: Southern California Edison, Rosemead, Calif.

[21] Appl. No.: 09/239,228

[22] Filed: Jan. 29, 1999

[51] Int. Cl.[7] ..... A42B 1/24

[52] U.S. Cl. ..... 2/422; 2/171.5; 2/172; 2/202; 2/209.13; 2/906

[58] Field of Search ..... 2/6.2, 171.4, 171.5, 2/171.7, 172, 202, 209.13, 209.3, 209.7, 422, 423, 906, 909, 918

[56] References Cited

U.S. PATENT DOCUMENTS

| | | | |
|---|---|---|---|
| 1,262,111 | 4/1918 | Slotoroff | 2/423 |
| 1,879,353 | 9/1932 | Levi | 2/6.2 |

OTHER PUBLICATIONS

Article entitled "Improved Radiological Controls" by Dick Warnock, in *Radiation Protection Management,* May/Jun. 1997.

Article entitled "San Onofre Gets Wired for Refueling" by Sherry C. Folsom, in *Nuclear News,* Jun. 1997.

*Primary Examiner*—Diana Oleksa
*Attorney, Agent, or Firm*—Sheldon & Mak; Denton L. Anderson

[57] ABSTRACT

The invention is a protective head gear ("cap") useful for work within hazardous environments, especially within radioactive environments. The protective cap includes: (a) a hood for covering a substantial portion of the head of a user, the hood having a top portion, a rear portion and opposed side portions, (b) a top flap centrally disposed on the top portion of the hood, the top flap being reversibly opened and closed to reversibly accept and retain the lateral support bridge of an audio head set, (c) a pocket disposed on the hood for accepting and retaining a remotely transmitting dosimeter probe and a passive dosimeter, (d) opposed ear openings for exposing the ears of the wearer of the hood so as to allow the wearer to position the ear piece portions of an audio head set over the user's ears, and (e) ear opening flaps for reversibly covering and uncovering each ear opening, each ear opening flap being sufficient in size to cover each ear opening when the wearer is wearing an audio head set.

18 Claims, 2 Drawing Sheets

HEAD GEAR FOR WORK IN RADIOACTIVE ENVIRONMENTS

FIELD OF THE INVENTION

This invention relates generally to head gear and, specifically, to hear gear used in hazardous environments.

BACKGROUND OF THE INVENTION

Since the earliest days of the Industrial Revolution, industry has struggled to safely conduct plant maintenance and other necessary work within hazardous environments. Prior to the second half of this century, most such hazardous environments involved hazardous chemical agents. Since 1950, such hazardous environments may also involve radioactive agents. Industry is continuously working towards improving equipment and techniques which will make working within such hazardous environments safer.

The nuclear power industry has been especially active in this regard. The problem faced by the nuclear power industry is how to safely conduct maintenance and other necessary work within the large confining structures or areas wherein potential sources of radioactivity are typically housed. Work within such confining structures requires extensive efforts to minimize dangers to workers from exposure to radioactive material. Such efforts have included the employment of personal dosimeters to monitor the individual radiation exposure of each worker. Also, such efforts have increasingly included the use of audio communication tools, such as walky-talkies, hardwired intercoms and cellular phones. Use of such tools allow supervisory personnel located outside the confining structure or area to assist in a more efficient—and, therefore, a more swift—completion of the work within the hazardous area.

Traditionally, personal dosimeter devices have been attached to the protective clothing of the worker by tape or other ad-hoc means. Under working conditions, the dosimeters tend to become dislodged from the clothing of the worker. Accordingly, there is a need for worker protective clothing which can simply and efficiently retain personal dosimeters.

The use of audio communications equipment has also experienced problems. Because the work area is generally extremely noisy, audio communication requires the use of a head set. The head sets are bulky and difficult to use with conventional head gear of the prior art. When the head set is worn on the inside of the head gear, the hear gear, often will not fit. When worn on the outside of the head gear, the user often has difficulty hearing voice communication through the head set. Also, when the head set is worn on the outside of the head gear, the head set frequently slips about on the head of the user or falls off altogether.

Accordingly, there is a need for an improved head gear for use by workers working in hazardous environments which avoids the above-described problems in the prior art—in an efficient and inexpensive manner.

SUMMARY

The invention satisfies this need. The invention is a combination comprising: (a) a hood for covering a substantial portion of the head of a user, the hood having a top portion, a rear portion and opposed side portions, (b) a top flap centrally disposed on the top portion of the hood, the top flap being reversibly opened and closed to reversibly accept and retain the lateral support bridge of an audio head set, (c) a pocket disposed on the hood for accepting and retaining a remotely transmit dosimeter, (d) opposed ear openings for exposing the ears of the wearer of the hood so as to allow the wearer to position the ear piece portions of an audio head set over the user's ears, and (e) ear opening flaps for reversibly covering and uncovering each ear opening, each ear opening flap being sufficient in size to cover each ear opening when the wearer is wearing an audio head set.

Typically, the hood is made from a flexible cloth or nylon material, such as cotton, cotton-polyester or nylon. Preferably, the top flap and the ear opening flaps are reversibly opened and closed by use of hook and loop fasteners.

The invention is ideal when used in combination with a unique vest as described in U.S. patent application Ser. No. 09/239,557, entitled "Vest for Work in Radioactive Environments," filed concurrently herewith. The invention is also ideal when used in combination with a unique module pack as described in U.S. patent application Ser. No. 09/240,917, entitled "Module Pack for Coordination of Work Within Hazardous Environments," filed concurrently herewith. Finally, the invention is ideal with used in combination with a unique system for protecting workers within hazardous environments as described in U.S. patent application Ser. No. 09/239,567, entitled "Protective System for Work in Radioactive Environments," also filed concurrently herewith. The entirety of each of these three patent applications is incorporated herein by this reference.

DRAWINGS

These features, aspects and advantages of the present invention will become better understood with regard to the following description, appended claims and accompanying figures where:

DETAILED DESCRIPTION

Figure 2:
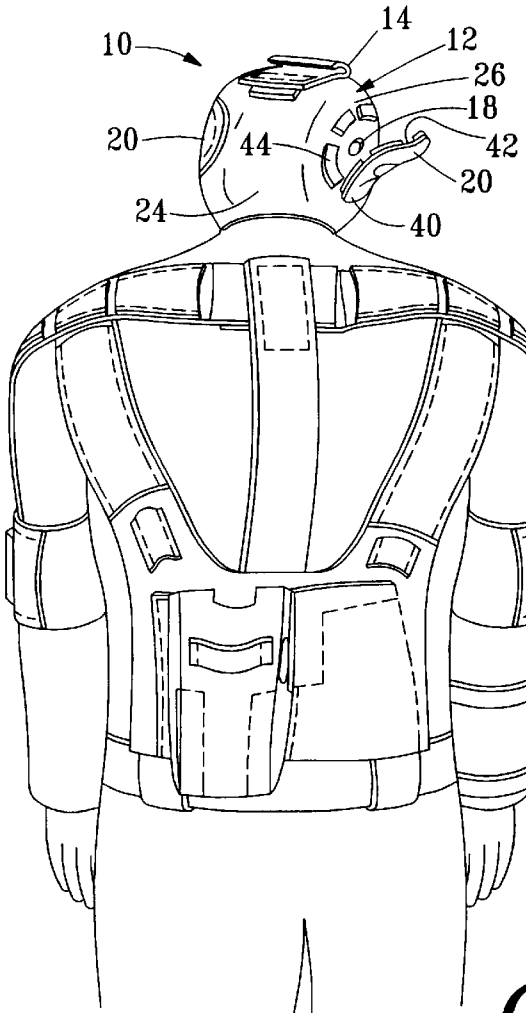
FIG. 2 is a perspective view of the rear and right sides of the combination illustrated in FIG. 1.
Figure 1:
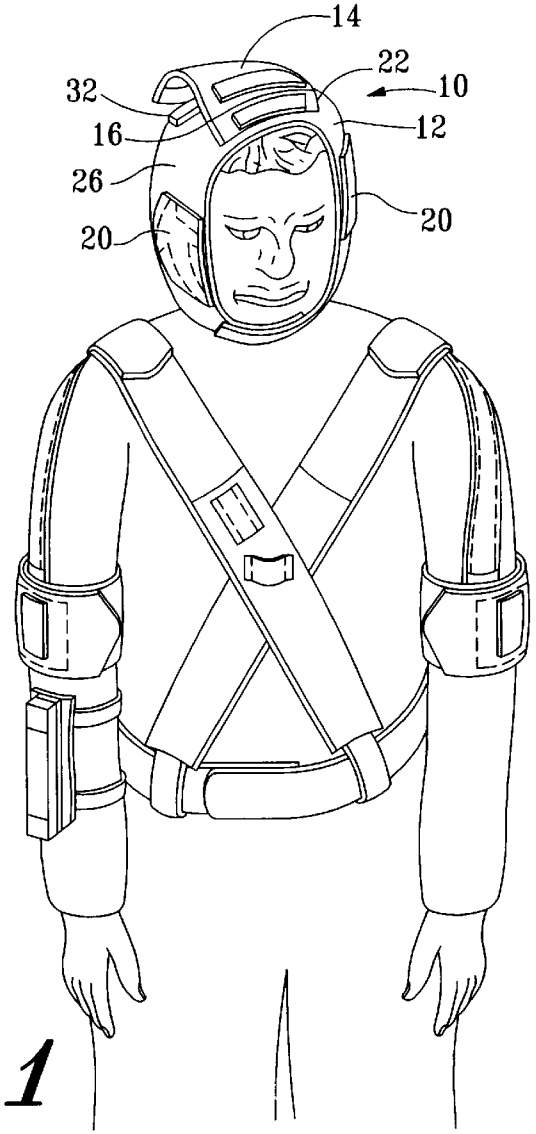
FIG. 1 is a perspective view of the front and right side of a combination having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a combination 10 comprising a hood 12, a top flap 14, a pocket 16, opposed ear openings 18 and opposed ear opening flaps 20.

The hood 12 has a top portion 22, a rear portion 24 and opposed side portions 26. The hood 12 fits close to the head of the user and covers a substantial portion of the head of the user. The hood 12 is typically made from a flexible material, such as a flexible cloth material. Cotton, cotton-polyester or nylon can be used as material for the hood 12, with cotton-polyester being preferable because it is easily cleaned, because it "breathes" and because it is readily incinerable, thus being inexpensive to dispose of as radioactive waste.

The top flap 14 is preferably centrally disposed on the top portion 22 of the hood 12. The top flap 14 is constructed so that it is reversibly opened and closed. This allows the top flap 14 to accept and retain the lateral support bridge 28 of an audio head set 30. In a typical embodiment, one side of the top flap 14 is sewn or otherwise permanently fastened to the hood 12 and the opposite side of the top flap 14 is reversibly fastenable to the hood by fasteners 32 such as hook and loop fasteners (e.g., Velcro® brand fasteners), snap fasteners, button fasteners, hook and eye fasteners, slot and tab fasteners or zipper fasteners. Hook and loop fasteners are generally preferred because of their ease of manufacture and use and because of their inherent "adjustability."

The pocket 16 is sized and dimensioned to accept and retain a remotely transmitting dosimeter probe ("teledosimeter") 34, such as the extremity probe manufactured by SAIC of San Diego, Calif. Such pockets 16 typically have a volume between about 5 and about 15 cubic inches, preferably between about 9 and about 12 cubic inches.

The pocket 16 may double as a passive dosimeter holder capable of also accepting and retaining a passive dosimeter 36. A typical passive dosimeter 36 is sold by Panasonic of Secaucas, N.J. as a model 802 dosimeter. Optionally, a passive dosimeter 36 can be retained on the hood 12 by a separate passive dosimeter holder 38, as illustrated in the drawings.

The opposed ear openings 18 define an open area suitable for allowing the user of the combination to conveniently employ an audio head set 30 while wearing the hood 12. Typically, both ear openings 18 define an open area between about 4 and about 9 square inches.

The opposed ear opening flaps 20 are sized and dimensioned to cover the ear openings 18 when the user of the combination is in a hazardous area. The ear opening flaps 20 must also be sized and dimensioned to cover the ear openings 18 when the user is wearing an audio head set 30.

The ear opening flaps 20 are reversibly opened and closed. In the embodiment illustrated in the drawings, this is accomplished by permanently fastening the lower side 40 of each ear opening flap 20 to the hood 12 and reversibly attaching the remaining periphery 42 of each ear opening flap 20 by reversible fasteners 44, such as hook and loop fasteners, snap fasteners, button fasteners, hook and eye fasteners, slot and tab fasteners and zipper fasteners. Again, hook and loop fasteners are preferable because of their ease of use and manufacture and because of their inherent "adjustability."

Figure 4:
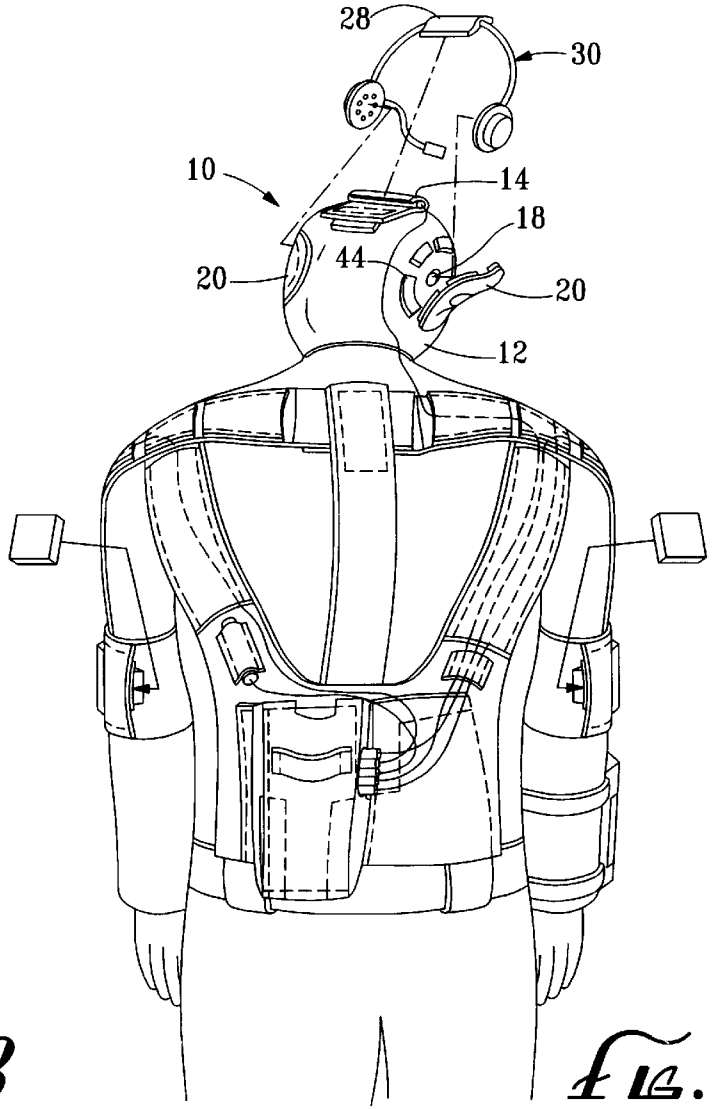
FIG. 4 is a perspective view of the rear and right sides of the combination illustrated in FIG. 2, showing the installation of various analytical and communications devices.
Figure 3:
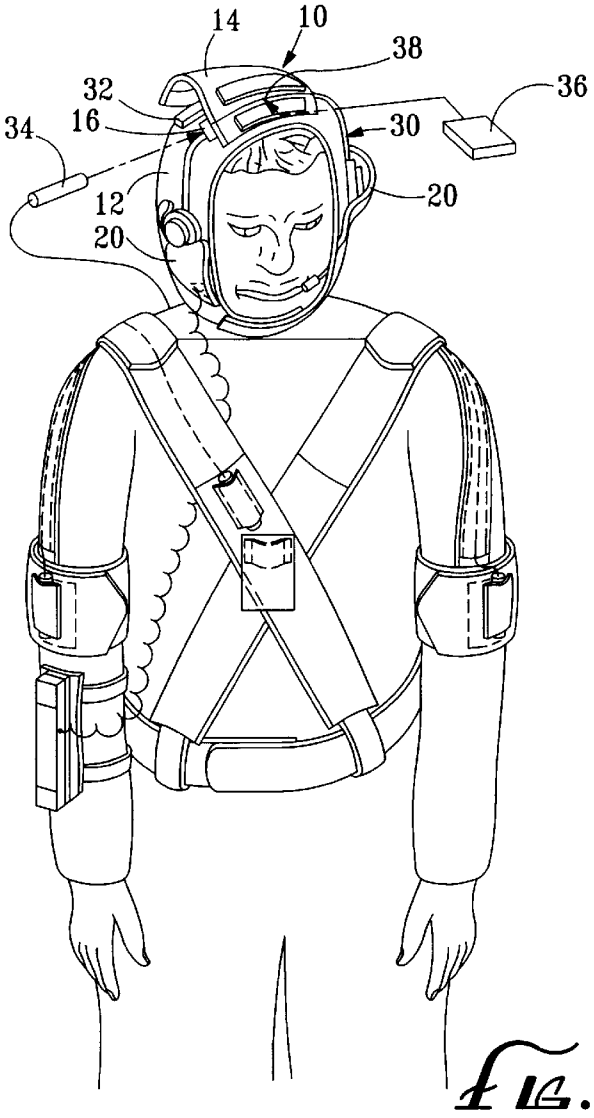
FIG. 3 is a perspective view of the front and right side of the combination illustrated in FIG. 1, shown carrying various analytical and communications devices.

In operation, the user of the combination 10 of the invention places the hood 12 over his or her head and opens the top flap and both ear opening flaps 20. The user then places an audio head set 30 upon his or her head as illustrated in FIGS. 3 and 4. Thereafter, the user closes the top flap 14 by sealing the rear edges of the top flap 14 with the reversible top flap fasteners 32. The closing of the top flap 14 securely retains the head set 30 on the head of the user.

The user also closes both ear opening flaps 20 by attaching the upper portions of the reversible ear opening flap perimeters 42 to the hood 12 using the ear opening flap fasteners 44.

Finally, the user places a transmitting dosimeter probe 34 within the pocket 16 and a passive dosimeter 36 in the passive dosimeter holder 38.

Use of the combination of the invention allows the user to conveniently and securely retain both a transmitting personal dosimeter and a passive personal dosimeter within the head gear. The combination of the invention also allows the user to conveniently and efficiently secure and use an audio head set. Because of the top flap, the head set is securely retained on the head of the user. Because of the ear openings and ear opening flaps, the user is able to easily hear verbal communications through the ear pieces of the head set while still maintaining maximum head coverage.

Having thus described the invention, it should be apparent that numerous structural modifications and adaptations may be resorted to without departing from the scope and fair meaning of the instant invention as set forth hereinabove and as described hereinbelow by the claims. In this regard, any element in a claim that does not explicitly state "means" for performing a specified function, or "step" for performing a specified function should not be interpreted as a "means" or a "step" clause as specified in 35 U.S.C. § 112.

What is claimed is:

1. A combination comprising:

(a) a hood for covering a substantial portion of the head of a user, the hood having a top portion, a rear portion and opposed side portions;

(b) a top flap centrally disposed on the top portion of the hood, the top flap adapted to be reversibly opened and closed to reversibly accept and retain the lateral support bridge of an audio head set;

(c) a pocket disposed on the hood for accepting and retaining a remotely transmitting dosimeter;

(d) opposed ear openings for exposing the ears of the wearer of the hood so as to allow the wearer to position the ear piece portions of an audio head set over the user's ears; and (e) ear opening flaps for reversibly covering and uncovering each ear opening, each ear opening flap adapted to be sufficient in size to cover each ear opening when the wearer is wearing an audio head set.

2. The combination of claim 1 wherein the hood is made from a flexible material.

3. The combination of claim 1 wherein the hood is made from a plastic material.

4. The combination of claim 1 wherein the hood is made from a material selected from the group of materials consisting of cotton, cotton-polyester and nylon.

5. The combination of claim 1 wherein the hood is made from cotton-polyester.

6. The combination of claim 1 wherein the top flap comprise fasteners taken from the group of fasteners consisting of hook and loop, snap, button, hook and eye, slot and tab, and zipper fasteners.

7. The combination of claim 1 wherein the top flap comprises hook and loop fasteners.

8. The combination of claim 1 wherein the pocket is disposed on the top portion of the hood.

9. The combination of claim 1 wherein the pocket is capable of also accepting and retaining a passive dosimeter.

10. The combination of claim 1 wherein the pocket defines a volume between about 5 cubic inches and about 15 cubic inches.

11. The combination of claim 1 wherein the ear openings define an open area between about 4 square inches and about 9 square inches.

12. The combination of claim 1 wherein the ear opening flaps comprise fasteners selected from the group of fasteners consisting of hook and loop, snap, button, hook and eye, slot and tab, and zipper fasteners.

13. The combination of claim 1 wherein the ear flaps comprise hook and loop fasteners.

14. A combination comprising:

(a) a flexible hood for covering a substantial portion of the head of a user, the hood having a top portion, a rear portion and opposed side portions;

(b) a top flap centrally disposed on the top portion of the hood, the top flap having hook and loop fasteners and adapted to be reversibly opened and closed to reversibly accept and retain the lateral support bridge of an audio head set;

(c) a pocket disposed on the hood for accepting and retaining a remotely transmitting dosemeter;

(d) opposed ear openings for exposing the ears of the wearer of the hood so as to allow the wearer to position the ear piece portions of an audio head set over the user's ears; and (e) ear opening flaps having hook and loop fasteners for reversibly covering and uncovering each ear opening, each ear opening flap adapted to be sufficient in size to cover each ear opening when the wearer is wearing an audio head set.

15. The combination of claim 14 wherein the hood is made from a material selected from the group of materials consisting of cotton, cotton-polyester and nylon.

16. The combination of claim 14 wherein the pocket is disposed on the top portion of the hood.

17. The combination of claim 14 wherein the pocket is capable of also accepting and retaining a passive dosimeter.

18. The combination of claim 14 wherein the ear openings define an open area between about 4 and about 9 square inches.

* * * * *